United States Patent [19]

Hagewood et al.

[11] Patent Number: 5,052,088

[45] Date of Patent: Oct. 1, 1991

[54] APPARATUS FOR CONTROLLED BRAKING OF A DRIVEN TEXTILE MATERIAL ENGAGING ROLL

[75] Inventors: John F. Hagewood, Matthews; Julius Darigo, Charlotte; Bruce S. McCoy, Monroe; John M. Single; Charles E. Jackson, Jr., both of Matthews, all of N.C.

[73] Assignee: McCoy-Ellison, Inc., Monroe, N.C.

[21] Appl. No.: 470,847

[22] Filed: Jan. 26, 1990

Related U.S. Application Data

[63] Continuation-in-part of Ser. No. 252,497, Sep. 30, 1988, Pat. No. 4,924,567, and a continuation-in-part of Ser. No. 257,052, Oct. 30, 1988, Pat. No. 4,916,783, and a continuation-in-part of Ser. No. 457,335, Dec. 27, 1989, Pat. No. 4,984,341.

[51] Int. Cl.[5] ..... D02H 13/08

[52] U.S. Cl. ..... 28/185; 28/172 R; 28/245

[58] Field of Search ..... 28/172, 185, 186, 187, 28/241, 242, 245, 271; 226/118, 119; 242/75.5; 264/40.1

[56] References Cited

U.S. PATENT DOCUMENTS

| | | | |
|---|---|---|---|
| 4,074,404 | 2/1978 | Schenk | 28/185 |
| 4,151,594 | 4/1979 | Stern | 242/58.1 X |
| 4,214,943 | 7/1980 | Stern | 242/58.3 X |
| 4,228,642 | 10/1980 | Dakin et al. | 57/83 X |
| 4,407,767 | 10/1983 | Seaborn | 264/40.1 |
| 4,480,799 | 11/1984 | Yano et al. | 242/25 R |
| 4,501,710 | 2/1985 | Abbott et al. | 264/40.1 |
| 4,573,245 | 3/1986 | Pfister | 28/187 |
| 4,669,159 | 6/1987 | Bogucki-Land | 28/185 |
| 4,852,225 | 8/1989 | Hagewood et al. | 28/187 |

FOREIGN PATENT DOCUMENTS

| | | | |
|---|---|---|---|
| 8701141 | 2/1987 | PCT Int'l Appl. | 28/185 |

OTHER PUBLICATIONS

"Draw-Warping-Mayer Warp Drawing Machine Developed Further"; *Man-Made Fiber Year Book (CTI)* 1986, pp. 104–105.

"Warp Preparation-Production of Warps From Flat Synthetic Filament Yarns"; *Textile Month*, May, 1984, pp. 48–50.

"Draw-Warping-Effect of Machine Downtimes in Draw-Warping on Yarn Properties"; *Man-Made Fiber Year Book (CTI)* 1987, pp. 118–119.

"Draw-Warping-Draw-Warping and Draw-Warp Sizing System for POY and Undrawn Yarns"; *Man-Made Fiber Year Book (CTI)* 1986, pp. 108–110.

"Draw-Warping-Draw Warping: The State of the Art"; *Man-Made Fiber Yearbook (CTI)* 1986, pp. 106–107.

"New Systems for Draw-Beaming POY Yarns"; *Fiber World* Sep., 1984, pp. 61–68.

*Primary Examiner*—Werner H. Schroeder
*Assistant Examiner*—John J. Calvers
*Attorney, Agent, or Firm*—Shefte, Pinckney & Sawyer

[57] ABSTRACT

In a textile warping system having one or more driven yarn engaging or yarn winding rolls, e.g. a driven warp beam, braking of each driven component is controlled by an individual pneumatic brake operated by a central programmable logic control system to brake the driven component according to a predetermined relationship of decreasing speed to elapsed braking time.

35 Claims, 4 Drawing Sheets

APPARATUS FOR CONTROLLED BRAKING OF A DRIVEN TEXTILE MATERIAL ENGAGING ROLL

CROSS REFERENCE TO RELATED APPLICATIONS

This is a continuation-in-part of each of the following United States patent applications: Ser. No. 252,497, filed Sept. 30, 1988, entitled "APPARATUS FOR CONTROLLING TENSION IN A TRAVELING YARN," now U.S. Pat. No. 4,924,567, issued May 15, 1990; Ser. No. 257,052, filed Oct. 30, 1988, entitled "APPARATUS FOR CONTROLLED BRAKING OF A DRIVEN YARN ENGAGING ROLL," now U.S. Pat. No. 4,916,783, issued Apr. 17, 1990; and Ser. No. 457,335, filed Dec. 27, 1989, entitled "APPARATUS FOR CONTROLLING TENSION IN A TRAVELING YARN," now U.S. Pat. No. 4,984,341, issued Jan. 15, 1991.

BACKGROUND OF THE INVENTION

The present invention relates generally to an apparatus for controlled braking of a driven textile material engaging roll and, more particularly, to such an apparatus specifically adapted for controlled braking of one or more driven rolls, such as a warp beam, in a textile warping system, including but not limited to textile draw warping systems.

In virtually all systems involving the handling of traveling continuous length textile materials by means of one or more driven guide rolls and/or a winding drum and the like, it is important when stoppage of the system becomes necessary that the rate of deceleration of the driven component or components be such as to not adversely affect the maintenance of some degree of uniformity in the tensioning of the continuous length textile material. In many circumstances, it is necessary or highly desirable in such systems to effect stoppage of the traveling movement of the textile material rapidly, e.g., when a breakage of the traveling material requires repair or when the driven components are operated at high speeds or otherwise have significant inertia, and accordingly it is common to brake the driven components to a standstill. Such factors are of particular concern in systems having plural independently driven components engaging the traveling textile material, especially if the driven components are operated at differing normal driven speeds or have differing inertial properties, which necessitate that the driven components be decelerated, whether by braking or otherwise, in synchronism with one another to avoid undesirable increases or decreases in the tension in the traveling textile material between the driven components.

For example, in a textile warping system, a plurality of yarns are fed in parallel side-by-side relationship to a warp beaming machine whereat the yarns are wound side-by-side onto a warp beam. While the traveling speed of the yarns is desirably maintained substantially constant during normal operation, the driven axial speed of the warp beam must be progressively decreased over the course of the winding operation to maintain its peripheral surface speed, i.e. its yarn take-up speed, substantially constant as the progressive winding of the yarns about the warp beam gradually increases its effective diameter. As will also be understood, the overall mass of the warp beam and the attendant inertia thereof increases in relation to the increasing effective diameter of the beam. Accordingly, when stoppage of a warping system is necessary, dramatic increases or decreases in the tension of the traveling yarns being delivered to the warp beam are likely to result, which may result in yarn breakage or other yarn damage, unless the warp beam is stopped in a controlled manner.

Similarly, in a textile draw-warping system, a plurality of continuous synthetic filament yarns are fed in parallel side-by-side relationship through a drawing unit wherein the yarns are subjected to a drawing operation between spaced sets of drive rolls driven at differing speeds and subsequently the yarns are delivered to a warp beaming machine for winding side-by-side onto a warp beam. During normal operation, the respective driven speeds of the guide rolls in the drawing unit are maintained substantially constant, while the driven speed of the warp beam is progressively decreased over the course of the winding operation as in other textile warping systems as described above. Thus, when it is necessary to stop a draw-warping system, yarn tension variations are likely to result either or both between the differentially driven guide rolls in the drawing unit and between the downstream drawing unit guide rolls and the warp beam, unless the drawing unit guide rolls and the warp beam are stopped synchronously with one another.

Conventionally, compatible braking of the differentially driven drawing unit guide rolls and the warp beam is known to be accomplished in two possible manners. First, electrically-operated brakes may be applied to the driven components which are mechanically interconnected through a common gear box for synchronized braking. In another system, the respective drive motors for the driven components are braked dynamically in synchronism. While generally effective for their intended purpose, these conventional braking systems have several disadvantages. In the first type of braking system, the use of a gear train mechanically interconnecting the driven members undesirably increases the complexity and cost of the overall apparatus. With respect to dynamic braking systems, the maximum rate at which a drive motor can be braked dynamically is limited by the power rating of the motor and, thus, drive motors of relatively high power ratings must be utilized in order to achieve effective dynamic braking and, even so, the maximum practical operating speed of the draw-warping system is still limited by the dynamic braking ability of the drive motors utilized. Further, in typical dynamic braking systems, no means is provided for maintaining the braking rates of the individual drive motors in synchronism in the event undesirable deviations in braking occur.

SUMMARY OF THE INVENTION

It is accordingly an object of the present invention to provide an apparatus by which the braking of a driven textile material roll may be controlled in a predetermined manner. Another object of the present invention is to provide such a controlled braking apparatus wherein deviations from the desired rate of braking are detected and corrected. It is a further object of the present invention to provide such a controlled braking apparatus capable of braking independently driven rolls synchronously with one another, particularly in a textile draw-warping system.

As used herein, the term "yarn" is intended to generically encompass substantially any continuous length strand-like textile material, e.g., yarns per se, threads, continuous length filaments, etc. The term "web" is intended to generically encompass substantially any continuous length flat or open width textile material, e.g. fabrics whether of woven, knitted, nonwoven, or other construction. The term "continuous length textile material," or simply "textile material," is intended to generically encompass all such "yarns" and "webs" as well as any other textile or like material produced in a substantially continuous length form.

Briefly summarized, the braking apparatus of the present invention basically includes a device for applying a variable braking force to the driven textile material engaging roll and an arrangement for controlling operation of the braking device according to a predetermined program, preferably, for example, through a programmable logic controller. Basically, the braking program arrangement is adapted for controlling the variable braking device for decelerating the driven roll in a predetermined relationship of decreasing roll speed to elapsed braking time.

As necessary or desirable, a sensing device may be provided for detecting the speed of the driven roll and the braking program arrangement may be provided with an auxiliary control program responsive to the roll speed sensing device to actuate either dynamic braking or driving of the driven roll in conjunction with the variable braking device to correct deviations in the detected speed of the roll from its predetermined speed-to-time relationship.

Preferably, the braking device is a fluid-actuated brake such as a conventional pneumatic brake, having an associated adjustable regulator valve or the like capable of supplying a pressurized operating fluid, e.g. air, to the fluid-actuated brake at a selectively variable pressure for generation of a correspondingly variable braking force. The braking program arrangement controls operation of the adjustable valve for controlling the pressure at which the pressurized operating fluid is supplied to the brake in order to achieve control of the deceleration of the roll at the predetermined speed-to-time relationship. The braking control program is also preferably adapted for adjusting the predetermined speed-to-time relationship of the roll as a function of its driven speed detected by the sensing device prior to braking actuation. For example, the braking program may be adapted to control roll deceleration to a standstill within a substantially uniform distance of travel of the continuous length textile material engaging the roll from any speed of the roll within a range of possible driven speeds of the roll, which is advantageous in embodiments of the present invention in a textile warping system, e.g. wherein the driven roll to be braked is a warp beam. The roll speed sensing device may advantageously be a tachometer associated with the roll drive motor. The valve is preferably adjustable electrically in relation to varying of a characteristic of the electrical supply to the valve, e.g. the operating voltage supply or the electrical current supply to the valve.

In embodiments of the braking apparatus wherein the driven roll to be braked is arranged for winding of the textile material thereabout, e.g. a textile warp beam, another sensing arrangement is provided for determining the wound diameter of the textile material on the roll and the braking program arrangement is adapted for adjusting the predetermined speed-to-time relationship according to the total mass of the roll and the material wound thereabout as a function of the determined wound diameter of material on the roll. The diameter sensing arrangement may advantageously be an ultrasonic device for measuring the radial depth of material windings on the roll to enable extrapolation therefrom of the total effective wound diameter of the roll.

In embodiments wherein a second textile material engaging roll driven by a second drive motor is arranged for engaging the textile material in sequence with the first-mentioned roll, a separate fluid-actuated brake is provided for the second roll with a separate associated adjustable regulator valve and, optionally, a separate associated speed detecting device. The braking program is adapted to independently control braking of the second roll through the associated brake and, optionally, as necessary or desirable, through dynamic braking and/or driving of the drive motor to the second roll, simultaneously with, and in a predetermined relation to, the braking of the first roll to maintain predetermined tension in the textile material between the rolls.

In such embodiments, the wound diameter of the textile material on the first roll may be extrapolated from a determination of a comparison of the axial speeds of the first and second rolls.

In such embodiments, a device may be provided for determining, either directly or indirectly, whether one of the first and second rolls reaches a standstill earlier than the other and the braking control program may be adapted to adjust the predetermined speed-to-time relationship of one of the rolls as a function of such determining device for controlling deceleration of the first and second rolls to a standstill substantially simultaneously upon a succeeding actuation of the braking apparatus.

The braking apparatus may also be provided with a device for monitoring tension in a textile material engaging the roll and the braking program arrangement may be adapted for controlling the variable braking device to control material tension in a predetermined relationship of tension to elapsed time of actuation of the variable braking device. In this manner, the braking apparatus is enabled to compensate for factors such as the gradual wearing of the braking device over a period of time.

For example, the braking apparatus of the present invention may be advantageously embodied in a textile draw warping system wherein a plurality of synthetic continuous filaments travel in sequence peripherally over a first set of guide rolls driven by a common drive motor and a second set of guide rolls driven by a separate common drive motor at a greater surface speed than the first set of rolls to achieve drawing of the filaments between the two sets of rolls, following which the filaments are wound about a warp beam in a warp beaming machine driven by a third drive motor. A separate fluid-actuated brake is provided for each of the guide rolls and also for the warp beam and a separate adjustable regulator valve is respectively associated with each brake. Likewise, individual speed detecting devices are associated with the three respective drive motors. The braking control arrangement has a primary control program which individually controls adjustment of each valve for controlling the fluid pressure supplied to each brake and, in turn, to control deceleration of each roll of the first set of rolls at a common speed-to-time relationship, to likewise control deceleration of each roll of the second set of rolls at their own respective speed-to-time relationship, and to control deceleration of the warp beam at its own speed-to-time relationship, the respective speed-to-time relationships being related to one another so as to maintain a predetermined ratio between the common speed of the first set of rolls, the common speed of the second set of rolls, and the warp beam speed during the braking process. The braking control arrangement may also be provided with an auxiliary control program which is likewise independently responsive to the individual speed detecting devices to independently actuate either dynamic braking or driving of the respective drive motors, as necessary, to correct deviations from the predetermined speed-to-time relationships.

DESCRIPTION OF THE PREFERRED EMBODIMENT

Figure 1:
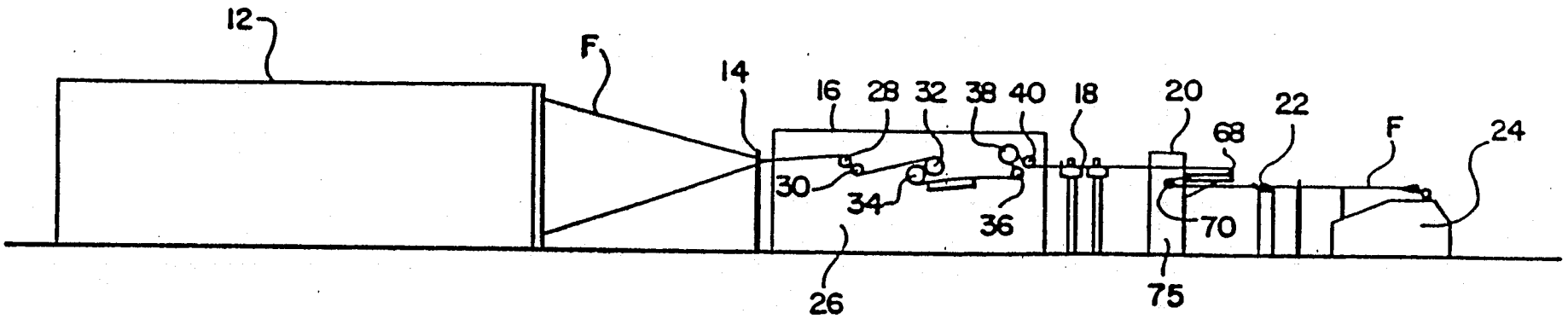
FIG. 1 is a schematic side elevational view of a draw-warping system of the type in which the braking apparatus of the present invention may be embodied.

Referring now to the accompanying drawings and initially to FIG. 1, a textile draw-warping system of the type in which the braking apparatus of the present invention may be incorporated is shown schematically in side elevation. Basically, the draw-warping system includes a creel, representatively indicated at 12, which supports a plurality of individual packages of partially oriented synthetic continuous filaments, such as polyester or nylon, which are fed as represented at F generally in side-by-side relationship through an eyeboard 14 to a drawing apparatus 16 and travel therefrom through a filament inspecting device 18, a tension controlling apparatus 20, and an oiling device 22, to a warp beaming machine 24, commonly referred to as a warper. While the braking apparatus of the present invention is herein illustrated and described in its preferred use for controlling braking of the driven roll components of the described draw-warping system, such description is only for purposes of illustration in order to provide an enabling disclosure of the best mode of the present invention. Those persons of skill in the art will readily recognize that the present braking apparatus is of a broad utility and is therefore susceptible of many other applications and embodiments whenever it is necessary or desirable to control braking of a driven yarn engaging or yarn winding roll. By way of example but without limitation, the present braking apparatus may also be incorporated in other textile warping systems, as hereinafter indicated, as well as any other textile yarn handling system, web handling system, or other textile system for handling continuous length textile material or the like.

Figure 2:
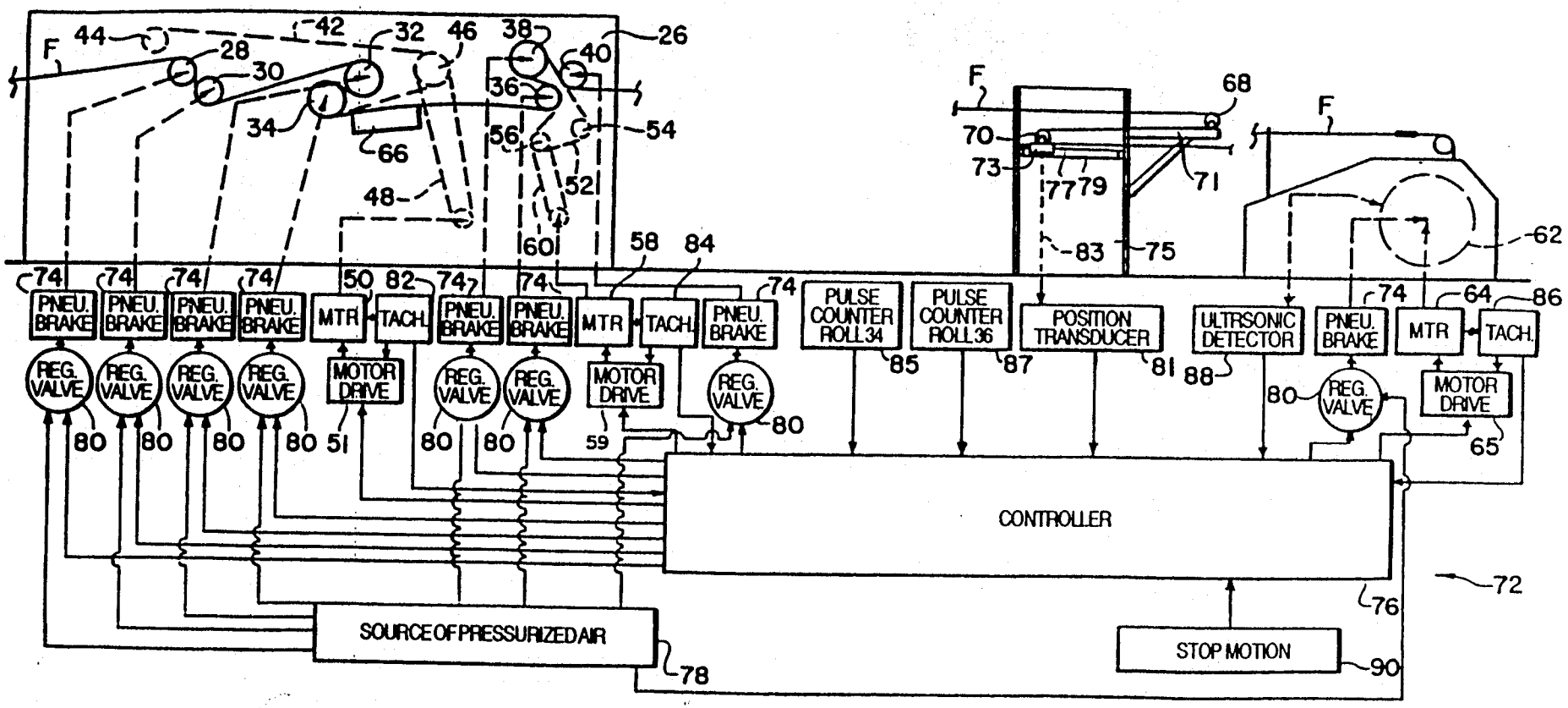
FIG. 2 is a schematic diagram of the braking apparatus of the present invention as incorporated in the draw-warping system of FIG. 1 for controlling braking of two sets of drawing rolls in its drawing unit and the warp beam in its warp beaming machine.

In the draw-warping system of Figure the drawing apparatus 16 includes a plurality of driven draw rolls and the warp beaming machine 24 supports a driven warp beam by which the filaments F are caused to travel through the draw-warping system. The specific construction of the drawing apparatus 16 is more fully described in U.S. Pat. No. 4,852,225, issued Aug. 1, 1989, entitled "Draw Warping Apparatus," which is commonly assigned with the present invention to McCoy-Ellison, Inc., the disclosure of such patent being incorporated herein by reference. Basically, the drawing apparatus 16 has an upstanding central frame 26 by which a series of draw rollers, including a feed roller 28, a swing roller 30, a pair of heated godet rollers 32, 34 and three take-up rollers 36, 38, 40 are rotatably supported to extend outwardly in cantilevered fashion from each opposite side of the frame 26 for training of the partially oriented filaments F in sequence peripherally about the rollers as shown. Within the interior of the frame 26, the feed roll 28, the swing roll 30 and the godet rolls 32, 34 are synchronously driven in common by an endless drive belt 42 trained in series about the interiorly mounted portion of such rolls as well as about an idler pulley 44 and a drive pulley 46 which, in turn, is driven through another drive belt 48 from a drive motor 50, as shown in FIG. 2. Similarly, the take-up rolls 36, 38, 40 are synchronously driven in common by a drive belt 52 trained peripherally about each thereof and about an idler pulley 54 and a drive pulley 56 which, in turn, is driven by a drive motor 58 through another drive belt 60. A heated platen 66 is positioned for contact with the filaments F along the extent of their travel from the godet roll 34 to the first take-up roll 36 for heating the filaments F to a more elevated temperature sufficient to achieve crystallization of the filaments. The warp beaming machine 24, which may be of substantially any conventional construction, basically includes a warp beam 62 rotatably driven by a drive motor 64 for progressively winding the filaments F about the beam 62 in side-by-side relation.

Each of the drive motors 50, 58, 64 are conventional variable speed electric motors, control of which is provided through a respective associated electronic motor drive 51, 59, 65 to allow the draw rolls and the warp beam to be driven at compatible speeds for cooperatively transporting the filaments F through the draw warping system. In normal operation, the respective drive systems for the feed, swing and godet rolls 28, 30, 32, 34 and for the take-up rolls, 36, 38, 40 are selectively set to drive the take-up rolls at a predetermined greater surface speed than the feed, swing and godet rolls to cause the filaments F to be drawn longitudinally to a predetermined desired degree from the point at which the filaments leave contact with the godet roll 34 to the first take-up roll 36 as the platen 66 crystallizes, i.e. heat sets, the filaments F. The drive system for the warp beam 62 is controlled to maintain substantially the same surface speed for filament winding take-up as the surface speed of the take-up draw rolls 36, 38, 40 to maintain a desirable tension level within the filaments F between the drawing apparatus 16 and the warp beaming machine 24 without causing further drawing thereof. As will be understood, the drive motor 64 for the warp beam 62 is operated at a gradually reducing speed over the course of the winding operation to maintain the surface speed of the warp beam 62 substantially constant as its effective diameter progressively increases as the filaments F are wound thereabout.

The tension controlling apparatus 20 is more fully disclosed in co-pending U.S. patent application Ser. No. 252,497, filed Sept. 30, 1988, entitled "Apparatus for Controlling Tension in a Traveling Yarn" commonly assigned with the present invention to McCoy-Ellison, Inc., of Monroe, N.C., which application is also incorporated herein by reference. Basically, the tension controlling apparatus 20 has an upstanding central frame 75 by which a pair of idler rolls 68, 70 are rotatably supported to extend outwardly in cantilevered fashion from each opposite side of the frame 75 for training of the filaments F in sequence peripherally about the rolls 68,70 as shown. The first idler roll 68 is mounted in a fixed disposition for rotation about a stationary axis at the forward end of a shelf 71 which projects forwardly from the frame 75. The second idler roll 70 is rotatably mounted at a slightly lower elevation than the first idler roll 68 on a movable shelf 73 supported within the frame 75 on a pair of guide rods 77 fixed to the frame to extend horizontally in parallel relation to one another and to the path of travel of the filaments F, whereby the axis of rotation of the second idler roll 70 is movable toward and away from the first idler roll 26 in a substantially horizontal path.

A piston-and-cylinder assembly 79 is mounted within the frame 75 intermediate and in parallel relation with the guide rods 77 immediately beneath the movable shelf 73. The piston-and-cylinder assembly 79 basically includes a cylindrical housing containing a reciprocable piston (not shown) dividing the housing interior into two operating chambers at opposite sides of the piston, with fittings being fixed at opposite ends of the housing for admitting and exhausting pressurized operating fluid, preferably pressurized air, into and from the respective chambers. A longitudinal slot is formed in the upwardly facing surface of the cylindrical housing through which a slide member disposed exteriorly of the housing is connected to the piston for sliding movement therewith along the slot, a sealing band extending from each opposite end of the slide member in slidable sealing relationship with the slot for sliding movement with the slide member to sealingly close the remaining extent of the slot. A clevis affixed to the underside of the movable shelf 73 is attached to the slide member for unitary movement of the movable shelf 73 and the second idler roll 70 with the slide member and the piston. Piston-and cylinder assemblies of the described type are known and commercially available and; accordingly, need not be more fully described herein. Of course, as will be understood, other types of piston-and-cylinder assemblies may be utilized in association with the shelf 73 and the second idler roll 70.

An electronic position transducer, shown only representatively at 81, is mounted at the forward end of the frame 75 in line with the piston-and-cylinder assembly 79. The transducer is of the type having a potentiometer (not shown) to which an extendable and retractable cable, only representatively indicated at 83, is operatively connected, the extending free end of the cable 83 being attached to the movable shelf 73 immediately beneath the idler roll 70 whereby the potentiometer is enabled to monitor the position of the second idler roll 70 in its horizontal path of travel and, in turn, to produce a variable voltage output as a function of the degree to which the cable is withdrawn from the transducer housing. Of course, as will be understood, any other suitable device capable of producing a variable signal output proportional to a changing linear position may be utilized instead of a potentiometer.

As will thus be understood, as the filaments F travel in series peripherally about the first and second idler rolls 68, 70, the traveling movement of the filaments F drives rotation of the rolls 68, 70. The forwardmost fitting of the piston-and-cylinder assembly 79 is supplied with pressurized air from a suitable source of supply to apply a biasing force urging movement of the second roll 70 within its horizontal path of movement away from the first idler roll 68 to maintain the second roll 70 in engagement with the filaments F. As will be understood, the biasing force exerted by the piston-and-cylinder assembly 79 on the second idler roll 70 is essentially constant at each position of the roll 70 along its horizontal path of movement, the amount of the biasing force being selected to be substantially equivalent to the desired amount of tension in the traveling filaments F whereby the prevailing filament tension counteracts the biasing force. So long as the tension prevailing in the filaments F remains constant at the desired tension level, the second idler roll 70 will not move within its horizontal path of movement either toward or away from the first idler roll 68. However, if the prevailing tension in the filaments F increases, the increased filament tension overcomes the biasing force to cause the second idler roll 70 to move along its path of movement toward the stationary idler roll 68. Likewise, in the event of a decrease in the prevailing tension in the filaments F, the biasing force overcomes the prevailing filament tension to cause the second idler roll 70 to move away from the first idler roll 68. Correspondingly, the cable 83 is retracted within or withdrawn from the transducer housing whereby the voltage output from the transducer changes to a degree corresponding to the degree of movement of the second idler roll 70.

As aforementioned, the driven speed of the warp beam 62 must be progressively reduced as the diameter of the wound filaments F increases over the course of the beaming operation so as to maintain the peripheral take-up speed of the warp beam substantially constant. For this purpose, the motor drive 65 to the warp beam drive motor 64 is controlled by a programmable microprocessor or other suitable programmable logic control system, indicated representatively at 76. Specifically, the variable voltage output of the transducer 8!, representing movement of the second idler roll 70 toward and away from the first idler roll 68 in response to increases and decreases, respectively, in the prevailing tension in the filaments F, is supplied to the controller 76 and the controller 76 is programmed to correspondingly vary the driven axial speed of the warp beam to compensate for such tension fluctuations. Specifically, assuming the prevailing tension in the traveling filaments F remains constant at a predetermined desired amount of tension, the second idler roll 70 should assume and not move from a corresponding "neutral" position intermediately along its horizontal path of movement. The controller 76 is programmed to control the motor drive 65 to the drive motor 64 to increase the driven axial speed of the warp beam 62 to a sufficient degree in response to recognition by the transducer 81 of movement of the second idler roll 70 from the neutral position in a direction away from the first idler roll 68 to compensate for the amount of the thusly-indicated decrease in the filament tension as a function of the degree of such movement of the second idler roll 70 represented by the amount of change in the voltage output of the transducer 81, thereby to return the idler roll 70 to its neutral position. Conversely, the controller 76 is similarly programmed to operate the motor drive 65 to the drive motor 64 to decrease the driven axial speed of the warp beam to a sufficient degree in response to recognition by the transducer 81 of movement of the second idler roll 70 from its neutral position in a direction toward the first idler roll 68 to compensate for the amount of the thusly-indicated increase in the tension in the filaments F as a function of the degree of such movement of the second idler roll 70 represented by the amount of change in the voltage output of the transducer 81, thereby to return the idler roll 70 to its neutral position. Variation of the driven speed of the warp beam 62 in this manner serves to maintain the filament tension substantially constant and, in turn, maintain the second idler roll 70 essentially at its predetermined neutral location during the warping operation.

As aforementioned, whenever it occasionally becomes necessary to stop the draw warping apparatus during its above-described normal operation, it is very important that the ratio between the differential surface speeds of the feed, swing and godet rolls 28, 30, 32, 34 and the take-up rolls 36, 38, 40 and between the take-up rolls 36, 38 40 and the warp beam 62 are maintained constant over the entire course of deceleration thereof to a standstill. It is equally important that the several draw rolls 28–40 of the drawing apparatus 16 and the warp beam 62 reach a standstill substantially simultaneously. It is also highly desirable that stoppage of the entire system be accomplished very rapidly, even when the draw warping system is operating at a very high filament traveling speed, e.g. between 500 and 1,000 yards per minute.

The braking apparatus of the present invention, generally indicated at 72 in FIG. 2, accomplishes these purposes by providing an individual pneumatically-operated braking device 74 at each driven draw roll 28–40 and also at the drive shaft of the warp beam 62 to provide a direct braking force to each driven component in a predetermined synchronized manner under the control of a braking program stored in memory in the programmable logic control system 76, which actuates operation of the brakes 74 while also controlling the drive motors 50, 58, 64 to the driven components according to a predetermined braking program stored in memory in the controller 76.

Operating air under pressure is supplied independently to the individual pneumatic brakes 74 from any suitable centralized source of pressurized air, representatively indicated at 78, through a corresponding plurality of adjustable regulator valves 80 each associated with a respective one of the pneumatic brakes 74. The adjustability of the regulator valves 80 permits the operating air to be selectively supplied independently to each pneumatic brake 74 at varying air pressures to, in turn, enable each brake 74 to generate a correspondingly variable braking force on the respective draw roll or warp beam with which the brake 74 is associated. Pneumatically operated brakes and adjustable pneumatic regulator valves are well known and commercially available. Substantially any such conventional type of pneumatic brake and substantially any compatible conventional regulator valve may be utilized so long as they are capable cooperatively of generating variable braking forces within a suitable range for braking the draw rolls and warp beam. In a preferred embodiment of the present invention, each of the regulator valves is of a type which is operable electrically to deliver the operating air at a regulated pressure which is selectively variable as a function of variation of the operating input voltage or variation of the electrical current supplied to the valves. For this purpose, each regulator valve 80 is independently connected electrically to the controller 76 for individual control of the operating input voltage supplied to the regulator valves 80 according to the predetermined braking program. Of course, those persons skilled in the art will recognize that various other types of braking devices and compatible controls therefor may also be utilized in accordance with the present invention.

Figure 3:
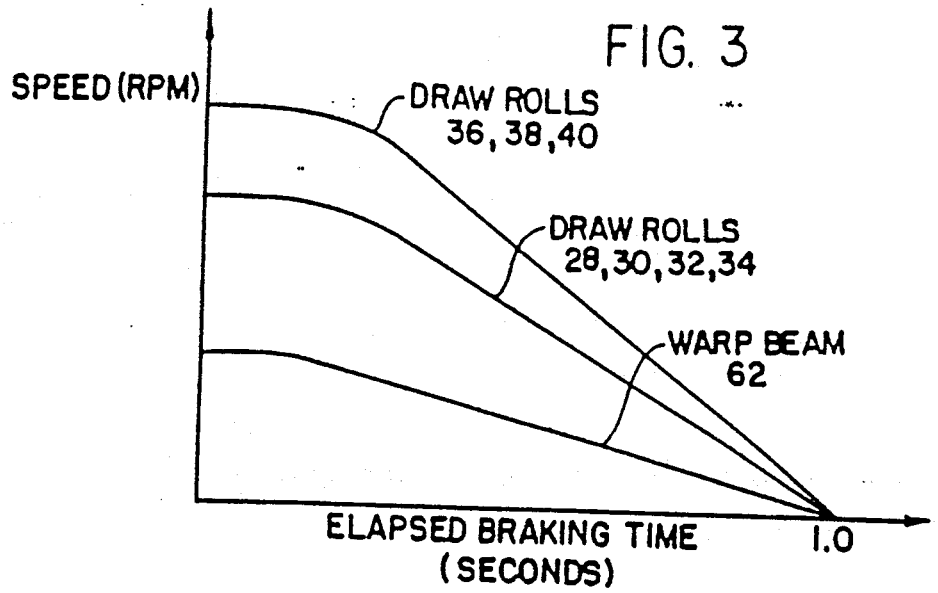
FIG. 3 is a graph representatively illustrating the respective relationships of decelerating speed against elapsed braking time for braking each set of drawing rolls and the warp beam of FIG. 2 in accordance with the present invention.

According to the present invention, upon stoppage of the draw warping system, each driven draw roll 28–40 and the warp beam 62 is to be braked to decelerate in a predetermined relationship of decreasing speed to elapsed braking time, with each of the commonly driven draw rolls 28, 30, 32, 34 being braked at the same speed-to-time relationship, with each of the commonly driven draw rolls 36, 38, 40 being likewise braked at a common predetermined speed-to-time relationship differing from that of the draw rolls 28, 30, 32, 34, and with the warp beam 62 being braked at its own respective predetermined speed-to-time relationship, the deceleration speed-to-time relationships for the driven components being compatibly set to maintain a constant ratio between the respective speeds of the two sets of the draw rolls and a constant ratio between the respective speeds of the draw rolls 36, 38, 40 and the warp beam 62 throughout the entire course of the braking operation. In this manner, all of the driven draw rolls and warp beam come to a standstill at substantially the same time and the tensioning in the filaments F is maintained constant or at least substantially constant during the course of the braking operation. In FIG. 3, individual braking curves for the draw rolls 28, 30, 32, 34, for the draw rolls 36, 38, 40 and for the warp beam 62 are plotted according to their respective decelerating speeds against elapsed braking time over the course of a braking operation from the initial point of simultaneous actuation of the individual pneumatic brakes 74 to the point of standstill of all driven components. As illustrated, an initial period of time elapses after actuation of the brakes 74 before any deceleration of the driven components actually begins, as of course would be expected, but the valves 80 are designed to react sufficiently rapidly that such period of time is only a matter of milliseconds. Thereafter, the relationship of decelerating speed to elapsed braking time for each driven component is linear, with the respective braking lines for the driven components converging to a common point as they simultaneously decelerate to a standstill, which under the present invention should occur within about one second after braking actuation is initiated.

To accomplish synchronous braking of the independently driven components in this manner, the desired braking curves for the components are initially determined and plotted and then, either by experimentation or mathematical extrapolation, corresponding curves are plotted for the amount of air pressure necessary to be supplied to each pneumatic brake 74 (including any necessary pressure variations) against elapsed braking time over the entire course of the braking operation to match the desired braking curve for each driven component and, for each such pressure curve, a respective curve is then plotted for the level of voltage which must be supplied to each regulator valve 80 (including any voltage changes) against elapsed braking time over the entire course of the braking operation to deliver the necessary air pressure to each pneumatic brake 74 to match its respective pressure curve.

Figure 4:
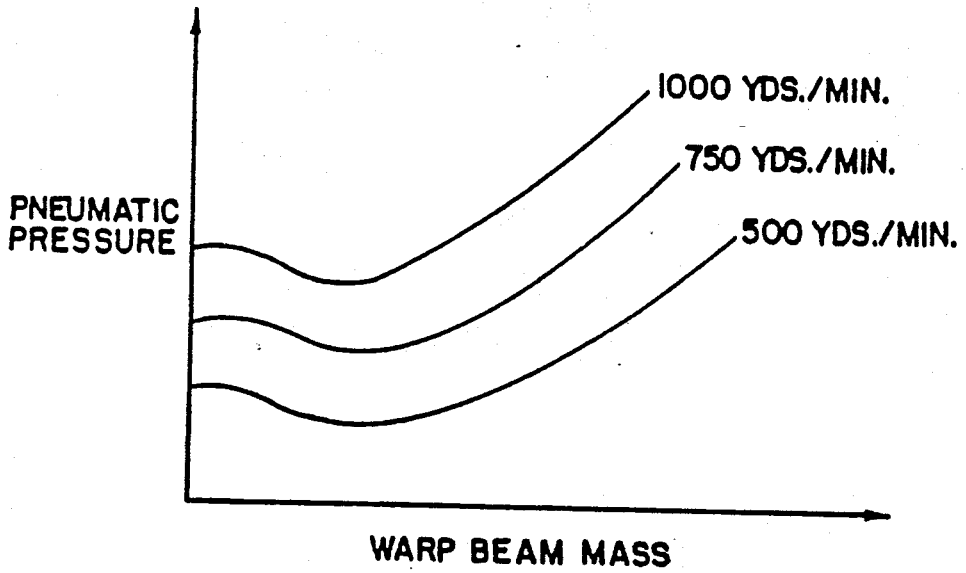
FIG. 4 is another graph illustrating the relationship between fluid braking pressure against the effective warp beam mass for braking the warp beam of FIG. 2 in accordance with the present invention.

As will be understood, the braking, pressure and voltage curves for each driven component will of course vary as a function of the driven speed of the components at the point in time at which braking is initiated. Accordingly, for each driven component, braking, pressure and voltage curves are developed for each increment of operating speed at which the components may be operated in the normal course of operation of the draw warping system. As aforementioned, the warp beam 62 is driven at a gradually decreasing axial speed over the course of the normal operation of the draw warping system in relation to its increasing effective diameter as the filaments F are progressively wound about the beam, so that the gradually increasing total mass of the warp beam, and the progressively changing inertia thereof, in addition to its gradually decreasing axial speed, affect the braking, pressure and voltage curves for the warp beam 62. Accordingly, the braking, pressure and voltage curves for the warp beam 62 are developed to take into account both its axial speed and its total mass at the point in time at which braking is initiated. This relationship is illustrated in FIG. 4 wherein three curves are plotted illustrating the relationship between the air pressure necessary to be supplied to the pneumatic brake associated with the warp beam 62 as the overall mass of the beam increases over the course of the draw warping operation at differing filament traveling speeds of the draw warping system.

The various braking, pressure and voltage curves (or at least the braking and voltage curves) are stored in the memory of the controller 76 for reference purposes in carrying out the braking program of the present invention. Tachometers 82, 84, 86, or other suitable speed sensing devices, are respectively connected to each of the drive motors 50, 58, 64 to monitor their operating speeds over the course of the draw warping operation and the controller 76 is electrically connected independently with each tachometer 82, 84, 86 to continuously monitor the sensed operating speeds of the drive motors 50, 58, 64 over the course of the draw warping operation. Each tachometer 82, 84, 86 is also electrically connected to the respective motor drive 51, 59, 65 which controls the associated motor 50, 58, 64 to enable the drive 51, 59, 65 to monitor the sensed operating speeds of the respective drive motors 50, 58, 64 throughout any braking operation.

Additionally, a suitable means or arrangement is provided for determining the actual diameter and mass of filaments wound on the warp beam 62 at any point during the warping operation. For example, in the embodiment illustrated, an ultrasonic detecting device 88 is arranged within the warp beaming machine 24 to continuously detect the progressively increasing effective diameter of the warp beam 62 as a function of the radial thickness of the filament build-up on the warp beam determined by reflecting ultrasonic sound waves off the central axial winding core of the warp beam 62. The controller 76 is electrically connected to the ultrasonic detecting device 88 to enable the controller 76 to control the gradual decrease of the axial speed of the warp beam 62 through its drive motor 64 over the course of the warping operation. For purposes of operation of the present braking apparatus, as more fully described below, the controller 76 may also be programmed to determine the total mass of the warp beam 62 at any given point in the draw warping operation as a function of the effective wound diameter of the beam. Alternatively or in addition to the ultrasonic detecting device 88, the controller 76 may be suitably programmed to extrapolate the wound diameter and mass of filaments on the beam by comparing the measurements of the tachometers 84 and 86 reflecting the operating speeds of the drive motors 58, 64. For purposes of operation of the present braking apparatus, this arrangement may provide a more accurate determination of the warp beam diameter and mass.

The operation of the braking apparatus 72 of the present invention may thus be understood. The controller 76 is operatively connected with a stop motion of the draw warping system, only representatively indicated at 90, to enable the controller 76 to recognize any actuation of the stop motion 90, e.g., upon a breakage of, or other substantial loss of tension in, one or more of the filaments F, indicating the necessity for stopping operation of the draw warping system. According to the braking program stored within and controlling operation of the controller 76, the controller 76 continuously senses the operating speeds of the drive motors 50, 58, 64 as determined by the tachometers 82, 84, 86 and also the effective wound diameter of the warp beam 62 as determined by the ultrasonic detecting device 88 or by alternative means and, upon actuation of the stop motion 90, the controller 76, in turn, immediately supplies independently to each of the regulator valves 80 a respective amount of operating voltage as determined by the braking, pressure and voltage curves stored within the controller 76 in response to the speed and diameter inputs received by the controller 76 from the tachometers 82, 84, 86 and the ultrasonic detecting device 88 at the time of stop motion actuation, so that, in turn, pressurized air from the centralized air source 78 is independently supplied simultaneously to each pneumatic brake 74 at the respective pressure level necessary to exert a braking force on the associated driven component for braking it in accordance with the applicable braking curve. As the braking operation progresses, the controller 76 continues to independently control the amount of voltage supplied to each regulator valve 80 to follow the applicable voltage, pressure and braking curves for each driven member. As will be understood, since the draw rolls 28, 30, 32, 34 are constrained by their common drive belt 42 to rotate in synchronism, such draw rolls will naturally tend to maintain the same decelerating surface speed as braking progresses, thereby automatically correcting any relatively minor deviations in any of the draw rolls 28, 30, 32, 34 from their intended braking curves. Likewise, the commonly driven draw rolls 36, 38, 40, will tend to maintain the identical surface speed over the course for braking.

As an optional means of correcting any deviations from the desired braking curves, upon initiation of a braking operation, the controller 76 also immediately communicates to each motor drive 51, 59, 65 the applicable predetermined desired braking curve for the re-

BEST AVAILABLE COPY spective driven components associated with the motor drives. Each motor drive 51, 59, 65 monitors the inputs from its associated tachometer 82, 84, 86, respectively, over the entire course of the braking operation to compare the actual speeds of the drive motors 50, 58 64 against the respective desired braking curves for their driven components. Since each motor drive 51, 59, 65 is connected independently with the respective drive motors 50, 58, 64, the motor drives 5!, 59, 65 are enabled to independently actuate either dynamic braking or driving of any one or more of the motors. Thus, according to an optional auxiliary routine of the braking program of the present invention, each individual motor drive 51, 59, 65 actuates dynamic braking of its associated drive motor 50, 58, 64 whenever its detected actual speed indicates an upward deviation of its driven component or components from the predetermined braking curve (i.e. a greater speed of the driven component(s) than intended at the prevailing point in elapsed braking time). Likewise, each motor drive 51, 59, 65 actuates driving of its associated drive motor 50, 58, 64 whenever its detected actual speed indicates a downward deviation of its driven component or components from the respective predetermined braking curve (i.e. a lesser than desired speed of the driven component(s) at the prevailing point in elapsed braking time). In this manner, the braking program serves to independently correct for deviations of any one or more of the driven components from their respective predetermined braking curves to insure that the rates of deceleration of the driven components are maintained in synchronism with one another at the predetermined desired speed ratios therebetween. Under ideal optimal circumstances, the auxiliary control of dynamic braking or driving of the motors 50, 58, 64 will be unnecessary since the pneumatic brakes 74 should control braking of the driven components in conformity to their respective predetermined braking curves. However, wear of the drive components over time as well as other factors may produce deviations in the desired braking operation of the pneumatic braking system and, accordingly, the auxiliary routine of the braking programs provides for correction under such circumstances.

While as above-described the synchronous braking of the independently driven draw rolls 28–40 and warp beam 62 according to the braking program of the present invention is adapted to bring the draw rolls and warp beam to a substantially simultaneous standstill, various factors and circumstances can cause the warp beam to reach a complete stop either slightly before or slightly after the stoppage of the draw rolls, most often imperceptibly. The tension control apparatus 20 enables the present braking apparatus to recognize and compensate for any such instances in which the draw rolls and warp beam do not stop substantially simultaneously. Specifically, by monitoring the location of the movable idler roll 70 in relation to its desired neutral position at the completion of a stoppage of the draw warping system, it can be determined whether the warp beam 62 or the draw rolls 36, 38, 40 reached a standstill in advance of the other. As will be understood, if the idler roll 70 is disposed at its neutral position at the completion of a system stoppage, this condition indicates that the warp beam 62 and the draw rolls 36, 38, 40 stopped simultaneously. On the other hand, however, if the idler roll 70 is disposed along its horizontal path of movement at a position more closely disposed to the warper than the neutral position of the roll 70, this condition indicates that the warp beam 62 did not reach a standstill until subsequent to the stoppage of the draw rolls 36, 38, 40. Conversely, if the idler roll 70 is disposed at a position along its horizontal path of movement more closely spaced to the drawing apparatus 26 than the neutral position of the roll 70, this condition indicates that the draw rolls 36, 38, 40 reached a standstill after the warp beam 62.

In either of the latter two circumstances, a suitable adjustment of the braking curve or curves of either or both the draw rolls and the warp beam is desirable. According to the preferred embodiment of the present invention, the controller 76 determines the standstill disposition of the idler roll 70 at the completion of each stoppage of the draw warping system in relation to the predetermined neutral position of the roll 70 by means of the voltage output transmitted by the transducer 81 to the controller 76. The braking program stored in the controller 76 is adapted to adjust the predetermined braking curve of the warp beam 62 as necessary to compensate upon the next succeeding stoppage of the draw warping system for any recognized deviation of the standstill disposition of the idler roll 70 from its predetermined neutral position. Specifically, following any stoppage of the draw warping system in which the warp beam 62 reached a standstill after the draw rolls 36, 38, 40 as indicated by a standstill disposition of the idler roll 70 more closely spaced to the warper than the neutral position of the roll 70, the braking program adjusts the braking curve of the warp beam 62 to increase the amount of air pressure to be supplied to the associated pneumatic brake 74 upon the next succeeding system stoppage and thereby to increase the braking force applied to the warp beam 62 sufficiently to stop it more quickly so as to reach a standstill simultaneously with the draw rolls 36, 38, 40. In turn, upon the next succeeding system stoppage, the idler roll 70 should reach a standstill precisely at its neutral position. Likewise, following any system stoppage in which the warp beam 62 reached a standstill in advance of the idler rolls 36, 38, 40 as indicated by a standstill disposition of the idler roll 70 more closely spaced to the draw rolls 36, 38, 40 than the neutral position of the roll 70, the braking program adjusts the braking curve for the warp beam 62 to decrease the amount of air pressure delivered to the associated pneumatic brake 74 upon the next succeeding system stoppage sufficiently to reduce the braking force applied to the warp beam 62 and thereby slightly delay its stoppage so as to reach a standstill substantially simultaneously with the draw rolls 36, 38, 40, in which event the idler roll 70 should reach a standstill disposition upon the next stoppage precisely at its neutral position.

Each of the braking curves for the warp beam 62 stored in the memory of the controller 76 may consist of a series of linear segments, each representing an increment in the progressive building of the warp beam 62, which segments combine to form a substantially continuous curve as represented in FIG. 4. In the preferred embodiment of the braking program, any adjustment necessary to be made in the applicable braking curve to correct for a non-simultaneous stoppage of the draw rolls 36, 38, 40 and the warp beam 62 is made only in the segment of the braking curve at which the stoppage occurred, but not in the subsequent segments of the curve. Thus, a change in the braking force exerted on the warp beam 62 is made as above-described for any succeeding stoppage which occurs within the increment of winding of the warp beam 62 represented by the same segment of its braking curve. However, after the progressive winding of the warp beam 62 has progressed beyond the increment wherein a system stoppage occurred which necessitated a braking curve adjustment, the braking program returns to the un-adjusted segment of the originally applicable braking curve, which is then adjusted only if and as necessary.

Figure 5:
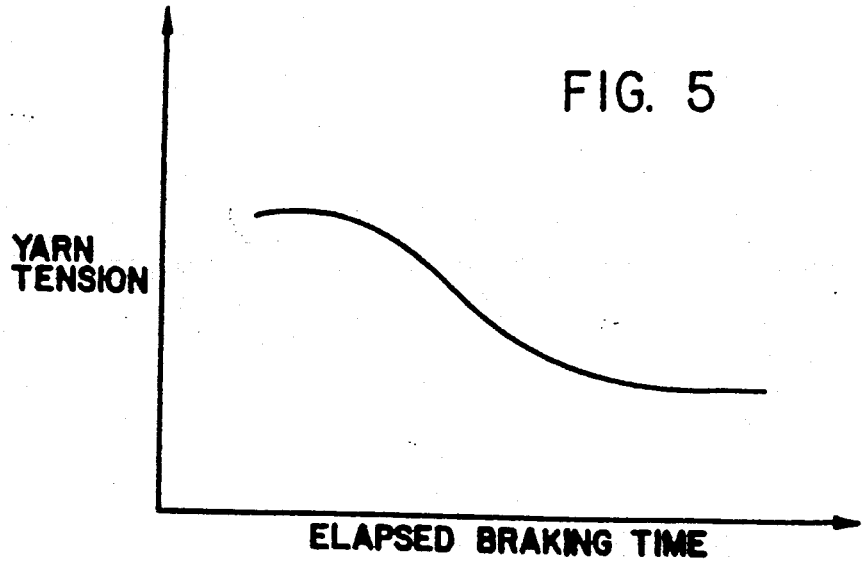
FIG. 5 is another graph illustrating the relationship between yarn tension and elapsed braking time for braking each set of drawing rolls and the warp beam of FIG. 2 in accordance with the present invention.

As will be understood, the respective braking curves established and stored in the controller 76 for braking of the draw rolls 28, 30, 32, 34, on the one hand, and the draw rolls 36, 38, 40 on the other hand, necessarily establish for any given stoppage of the draw warping system a desired relationship between the prevailing tension in the filaments F traveling from the godet roll 34 to the take-up roll 36 and the elapsed time over which braking of such draw rolls occurs. This desired profile of filament tension with respect to elapsed braking time is representatively depicted in FIG. 5. However, it will further be understood that external factors, such as the gradual wearing of the pneumatic brakes 74 over time, can cause the actual filament tension during system stoppages to deviate from the desired tension curve, even though the braking of the draw rolls 28–40 may precisely follow the applicable braking curves. Accordingly, the present invention further contemplates that the tension in the filaments F within the draw zone between the godet roll 34 and the take-up roll 36 should be monitored, either directly or indirectly, upon each system stoppage to enable deviations from the desired tension-to-braking time profile to be detected and corrected.

For this purpose, a pulse counter 85 is arranged in association with the godet roll 34 and a similar pulse counter 87 is arranged in association with the take-up roll 36, each pulse counter 85, 87 being of a type adapted to generate a signal, or pulse, for each increment of angular rotation of its associated roll of a predetermined number of angular degrees, whereby the degree of angular rotation of each roll 34 and 36 can be precisely determined during the course of each stoppage of the draw warping system. Each pulse counter 85, 87 is operatively connected with the controller 76 to transmit thereto the generated pulses. In turn, the braking program stored in the controller 76 is adapted to compare the number of pulses received from each pulse counter 85, 87 to determine an indication of the tension prevailing in the filaments F within the draw zone between the rolls 34, 36. When a deviation of the prevailing filament tension from the desired tension profile occurs, the braking program of the controller 76 automatically adjusts the regulator valves 80 to vary the air pressure delivered to the pneumatic brakes 74 associated with either or both the draw rolls 28, 30, 32, 34 and the draw rolls 36, 38, 40 sufficiently to automatically adjust their relative rates of angular rotation and thereby, in turn, correct for the recognized deviation from the desired tension profile as the stoppage of the draw warping system is completed. Of course, as will be recognized, any other means of monitoring filament tension deviations, either directly or indirectly, could be utilized, e.g., one or more tensiometers, on the filaments F within the draw zone.

As will be readily recognized, this braking apparatus of the present invention provides distinct advantages and improvements over known braking arrangements utilized in conventional draw warping systems. The present braking apparatus is markedly simplified over braking arrangements relying on mechanical gearing for synchronizing simultaneous braking of plural driven components and permits substantially more rapid braking than conventional dynamic braking systems without significant restriction on the normal operating speeds of the drawn warping system. As aforementioned, the braking apparatus of the present invention is designed to be capable of braking the disclosed drawn warping system from a normal operating speed transporting the filaments F up to 1,000 yards per minute to a complete standstill within the span of one second of braking tie. Further, the provision of the braking program of the present invention to provide primary control of braking of the driven components through regulation of the individual pneumatic valves and brakes according to programmed braking, pressure and voltage curves, and optional auxiliary correction of deviations through dynamic braking and driven operation of the drive motors, provides a substantially higher level of operational reliability than conventional braking systems.

Figure 6:
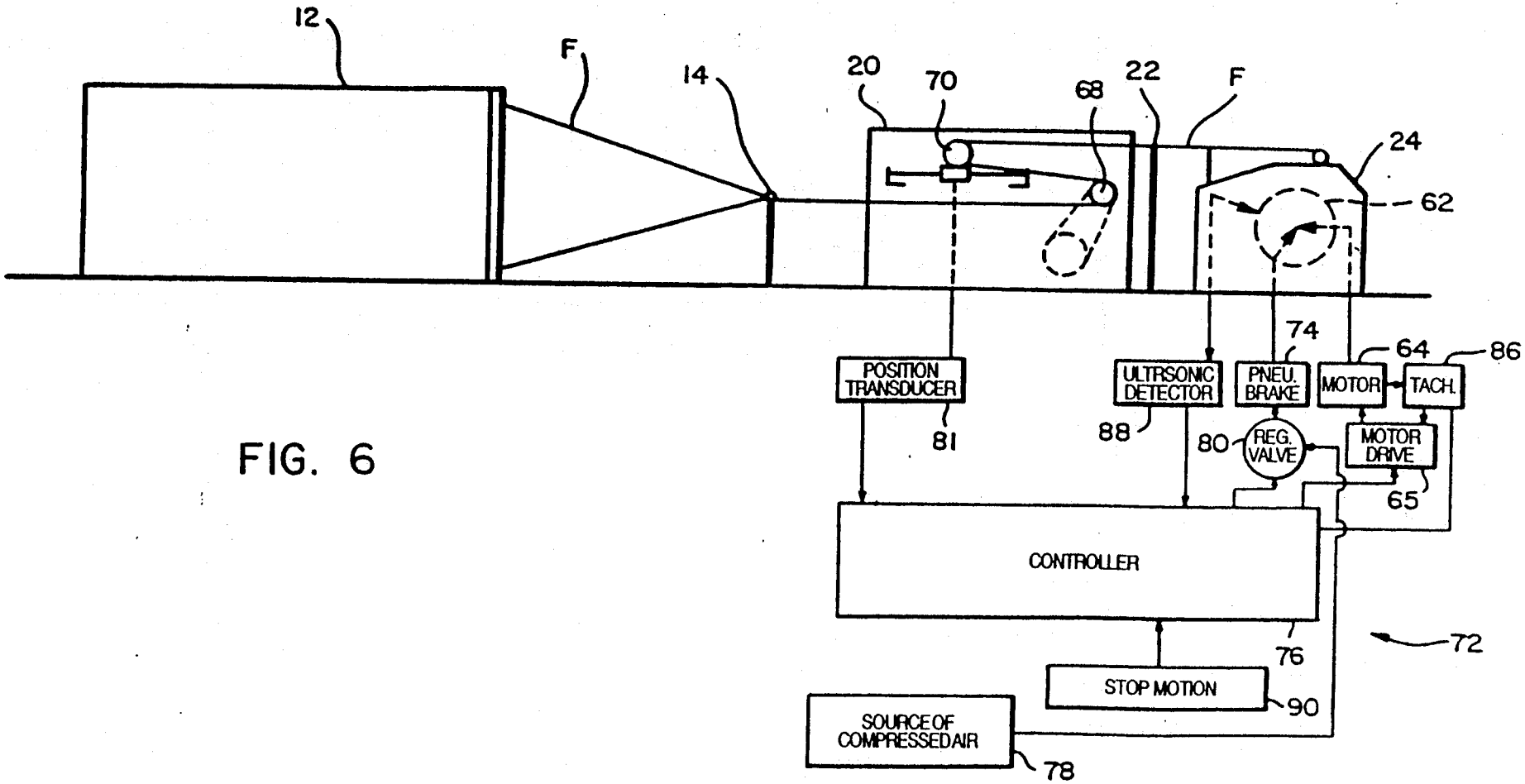
FIG. 6 is a schematic side elevational view, similar to FIG. 1, of another textile warping system in which the braking apparatus of the present invention may be embodied.

While the braking apparatus of the present invention has herein been described and illustrated as embodied in a draw warping system, it will be readily recognized by those persons skilled in the art that the braking apparatus of this invention is equally well adapted for a wide variety of other applications and embodiments in any textile material handling system in substantially any circumstance wherein it is desirable or necessary to control the braking of a driven roll which engages or on which is wound a traveling continuous length textile material, whether a yarn, a web or other such textile material. In particular, it is contemplated that the braking apparatus as above-described could be readily incorporated in substantially any other textile warping system, as representatively illustrated in FIG. 6. Basically, the representative textile warping system of FIG. 6 is substantially similar to the draw warping system of FIGS. 1 and 2, except for the omission of the drawing apparatus 16. A yarn package supporting creel 12 delivers a plurality of yarns F in side-by-side relation successively through an eyeboard 14, a tension controlling apparatus 20, and a comb or reed 22, onto a warp beam 62 of a warper 24, the operation of all of which is essentially the same as described above for the comparable components of the draw warping system of FIGS. 1 and 2. It will be recognized that, in such a warping system, the tension controlling apparatus 20 could be eliminated or incorporated into the structure of the warper 24, as appropriate or desirable. The warp beam 62 is driven by a drive motor 64, which in many warping systems is the only driven yarn engaging component. Such warping systems operate at substantially high speeds of yarn travel, as in the case of draw warping systems. Accordingly, when stoppage of the warping system becomes necessary, such as due to a yarn breakage, it is necessary to brake the warp beam 62 to a standstill as quickly as possible. The braking apparatus 72 of the present invention can readily accomplish this purpose, while also providing the ability to control the braking of the warp beam 62 according to a predetermined braking program which may establish differing braking curves to enable differing operational factors to be taken into account. For example, according to the present invention, it is contemplated to be highly advantageous in textile warping systems other than draw warping systems that braking of the warp beam 62 (and any other driven yarn-engaging components) be controlled upon each stoppage of the system to bring the multiple traveling yarns to a standstill within a constant yarn traveling distance regardless of the operational traveling speed of the yarns which prevails at the moment system stoppage is initiated. The braking apparatus 72 of the present invention uniquely enables this objective to be accomplished by providing differing braking curves for the warp beam 62 (and any other driven yarn-engaging components) for each differing yarn traveling speed of which the warping system is capable so that, irrespective of the yarn traveling speed at which the system operates in any given warping operation, the distance traveled by the multiple yarns during each stoppage of the system is substantially constant.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile draw warping system having a first set of upstream guide rolls driven by a common first drive means and a second set of downstream guide rolls driven by a common second drive means at a greater surface speed that said first set of rolls for drawing a plurality of synthetic continuous filaments traveling peripherally in sequence over said rolls, apparatus for controlled braking of said first and second sets of rolls, said apparatus comprising:

(a) a plurality of fluid actuated braking means each respectively associated with one of said rolls, (b) a plurality of adjustable valve means each respectively associated with one of said braking means for individually supplying a pressurized operating fluid to each said braking means at independently selectively variable pressures for generation of a correspondingly variable braking force by each said braking means, and (c) braking program means for individually controlling adjustment of each said valve means for controlling the pressure at which the pressurized operating fluid is supplied respectively to each said braking means for individually controlling deceleration of each said roll of said first set in a common predetermined relationship of decreasing roll speed to elapsed time of actuation of said braking means and for individually controlling deceleration of each said roll of said second set in another common predetermined relationship of decreasing roll speed to elapsed time of actuation of said braking means related to said common relationship of said first set of rolls for maintaining a predetermined ratio between the common speed of said first set of rolls and the common speed of said second set of rolls during braking.

2. Apparatus for controlled braking of guide rolls in a textile draw warping system according to claim 1 and characterized further in that said draw warping system comprises a warp beaming machine having a warp beam driven by a third drive means for winding said plural filaments about said beam, said braking apparatus further comprising another fluid actuated braking means associated with said warp beam, another adjustable valve means associated with said another braking means for supplying pressurized operating fluid to said another braking means at a selectively variable pressure for generating a correspondingly variable braking force by said another braking means, and means for determining the wound diameter of filaments on said warp beam, said braking program means being adapted for independently controlling adjustment of said another valve means for controlling the pressure at which the pressurized operating fluid is supplied to said another braking means for controlling deceleration of said warp beam in a predetermined relationship of decreasing speed of said warp beam to elapsed time of actuation of said another braking means related to said common speed-to-time relationship of said second set of rolls for maintaining a predetermined ratio between the common speed of said second set of rolls and the speed of said warp beam during braking, said braking program means being responsive to said diameter determining means for adjusting said predetermined speed-to-time relationship of said warp beam according to the total mass of said warp beam and filaments wound thereon as a function of the determined wound diameter of filaments on said warp beam.

3. Apparatus for controlled braking of guide rolls in a textile draw warping system according to claim 2 and characterized further by first means for detecting the common speed of said first set of rolls, second means for detecting the common speed of second set of rolls, and third means for detecting the common speed of said warp beam, said braking program means including means for independently adjusting each of said predetermined speed-to-time relationships for said first set of rolls, said second set of rolls and said warp beam, respectively, as a function of the respective drive speeds thereof detected by said first, second and third detecting means, respectively, prior to actuation of their said braking means.

4. Apparatus for controlled braking of guide rolls in a textile draw warping system according to claim 3 and characterized further in that each of said first, second and third detecting means comprises a tachometer associated with the respective said first second and third drive means.

5. Apparatus for controlled braking of guide rolls in a textile draw warping system according to claim 2 and characterized further in that said diameter determining means comprises means for ultrasonic measuring of the radial depth of textile material windings on said warp beam.

6. Apparatus for controlled braking of guide rolls in a textile draw warping system according to claim 2 and characterized further in that said diameter determining means comprises means for determining a comparison of the axial speeds of at least one of said second set of rolls and said warp beam and extrapolating therefrom the wound diameter of filaments on said warp beam.

BEST AVAILABLE COPY

7. Apparatus for controlled braking of guide rolls in a textile draw warping system according to claim 2 and characterized further in that said braking program means comprises a programmable logic controller.

8. Apparatus for controlled braking of guide rolls in a textile draw warping system according to claim 2 and characterized further in that each said valve means is electrically adjustable in relation to varying of a characteristic of an operating electrical supply thereto.

9. Apparatus for controlled braking of guide rolls in a textile draw warping system according to claim 8 and characterized further in that said braking means is adapted for actuation by pressurized air.

10. Apparatus for controlled braking of guide rolls in a textile draw warping system according to claim 2 and characterized further by means for determining whether one of said second set of rolls and said warp beam reaches a standstill earlier than the other thereof, said braking program means including means for adjusting said predetermined speed-to-time relationship of one of said second set of rolls and said warp beam as a function of said determining means for controlling deceleration of said second set of rolls and said warp beam to a standstill substantially simultaneously upon a succeeding actuation of said braking apparatus.

11. Apparatus for controlled braking of guide rolls in a textile draw warping system according to claim 1 and characterized further by means for monitoring tension in said filaments, said braking program means being adapted for controlling said valve means for controlling filament tension in a predetermined relationship of tension to elapsed time of actuation of said braking means.

12. Apparatus for controlled braking of first and second textile material engaging rolls driven respectively by first and second drive means, said first and second rolls being arranged for engaging a continuous length textile material in sequence with one another, said apparatus comprising first means for applying a variable braking force to said first roll, second means for applying a variable braking force to said second roll, and braking program means for controlling said first variable braking means for controlling deceleration of said first roll in a predetermined relationship of decreasing speed of said first roll to elapsed time of actuation of said first variable braking means and for independently controlling braking of said second roll by said second variable braking means simultaneously with, and in a predetermined relation to, braking of said first roll for maintaining predetermined tension in the textile material between said first and second rolls.

13. Apparatus for controlled braking of a driven textile material engaging roll according to claim 12 and characterized further by means for determining whether one of said first and second rolls reaches a standstill earlier than the other thereof, said braking program means including means for adjusting said predetermined speed-to-time relationship of one of said first and second rolls as a function of said determining means for controlling deceleration of said first and second rolls to a standstill substantially simultaneously upon a succeeding actuation of said braking apparatus.

14. Apparatus for controlled braking of first and second textile material engaging rolls driven respectively by first and second drive means, said first roll being arranged for winding of textile material thereabout and said second roll being arranged for engaging the textile material in advance of said first roll, said apparatus comprising means for applying a variable braking force to said first roll, braking program means for controlling said variable braking means for controlling deceleration of said first roll in a predetermined relationship of decreasing speed of said first roll to elapsed time of actuation of said variable braking means, and means for determining the wound diameter of textile material on said first roll, said diameter determining means comprising means for determining a comparison of the axial speeds of said first and second rolls and extrapolating therefrom the wound diameter of textile material on said first roll, said braking program means including means for adjusting said predetermined speed-to-time relationship according to the total mass of said first roll and textile material would thereabout as a function of the determined would diameter of textile material on said first roll.

15. Apparatus for controlled braking of first and second textile material engaging rolls driven respectively by first and second drive means, said first and second rolls being arranged for engaging a continuous length textile material in sequence with one another, said apparatus comprising first fluid-actuated means for braking said first roll, second fluid-actuated means for braking said second roll, means for supplying a pressurized operating fluid to said first fluid-actuated braking means at a selectively variable pressure for generation of a correspondingly variable braking force by said first fluid-actuated braking means, means for supplying a pressurized operating fluid to said second fluid-actuated braking means at a selectively variable pressure for generation of a correspondingly variable braking force by said second fluid-actuated braking means, and braking program means for controlling said fluid supplying means for controlling the pressure at which the pressurized operating fluid is supplied to said first braking means for controlling deceleration of said first roll in a predetermined relationship of decreasing speed of said first roll to elapsed time of actuation of said first braking means and for independently controlling braking of said second roll by said second fluid-actuated braking means simultaneously with, and in a predetermined relation to, braking of said first roll for maintaining predetermined tension in the textile material between said first and second rolls.

16. Apparatus for controlled braking of a driven textile material engaging roll according to claim 15 and characterized further by means for determining whether one of said first and second rolls reaches a standstill earlier than the other thereof, said braking program means including means for adjusting said predetermined speed-to-time relationship of one of said first and second rolls as a function of said determining means for controlling deceleration of said first and second rolls to a standstill substantially simultaneously upon a succeeding actuation of said braking apparatus.

17. Apparatus for controlled braking of first and second textile material engaging rolls driven respectively by first and second drive means, said first roll being arranged for winding of textile material thereabout and said second roll being arranged for engaging the textile material in advance of said first roll, said apparatus comprising fluid-actuated means for braking said first roll, means for supplying a pressurized operating fluid to said fluid-actuated braking means at a selectively variable pressure for generation of a correspondingly variable braking force by said fluid-actuated braking means, braking program means for controlling said fluid supplying means for controlling the pressure at which

BEST AVAILABLE COPY the pressurized operating fluid is supplied to said braking means for controlling deceleration of said first roll in a predetermined relationship of decreasing speed of said first roll to elapsed time of actuation of said braking means, and means for determining the wound diameter of textile material on said first roll, said diameter determining means comprising means for determining a comparison of the axial speeds of said first and second rolls and extrapolating therefrom the wound diameter of textile material on said first roll, said braking program means including means for adjusting said predetermined speed-to-time relationship according to the total mass of said first roll and textile material wound thereabout as a function of the determined wound diameter of textile material on said first roll.

18. Apparatus for controlled braking of first and second textile material engaging rolls according to claim 12, 14, 15 or 17 and characterized further by first means for detecting the speed of said first roll, and second means for detecting the speed of said second roll, said braking program means including means for independently adjusting each of said predetermined speed-to-time relationships for said first roll and said second roll, respectively, as a function of the respective drive speeds thereof detected by said first and second detecting means, respectively, prior to actuation of their said braking means.

19. Apparatus for controlled braking of first and second textile material engaging rolls according to claim 18 and characterized further in that each of said first and second detecting means comprises a tachometer associated with the respective said first and second drive means.

20. Apparatus for controlled braking of first and second textile material engaging rolls according to claim 12, 14, 15 or 17 and characterized further by means for monitoring tension in a textile material engaging said rolls, said braking program means being adapted for controlling each said variable braking means for controlling textile material tension in a predetermined relationship of tension to elapsed time of actuation of said variable braking means.

21. Apparatus for controlled braking of first and second textile material engaging rolls according to claim 12, 13, 15 or 17 and characterized further by first means for detecting the speed of said first, roll, and second means for detecting the speed of said second roll, said braking program means including auxiliary control means responsive independently to each said detecting means for independently controlling dynamic braking and driving of each said roll drive means in conjunction with the respective said variable braking means for correcting deviations in the detected speed of each said roll from its said predetermined speed-to-time relationship.

22. Apparatus for controlled braking of first and second textile material engaging rolls according to claim 12, 14, 15 or 17 and characterized further in that said braking program means is operative for controlling deceleration of said rolls from a full operating speed to a standstill.

23. Apparatus for controlled braking of a textile material engaging roll driven by a drive means, said roll being arranged for winding of textile material thereabout, said apparatus comprising means for applying a variable braking force to said roll, braking program means for controlling said variable braking means for controlling deceleration of said roll in a predetermined relationship of decreasing speed of said roll t elapsed time of actuation of said variable braking means, and means for determining the wound diameter of textile material on said roll, said diameter determining means comprising means for ultrasonic measuring of the radial depth of textile material windings on said roll, said braking program means including means for adjusting said predetermined speed-to-time relationship according to the total mass of said roll and textile material wound thereabout as a function of the determined wound diameter of textile material on said roll.

24. Apparatus for controlled braking of a textile material engaging roll driven by a drive means, said roll being arranged in a textile warping system for engagement of a plurality of textile materials traveling in side-by-side arrangement, said apparatus comprising means for applying a variably braking force to said roll, and braking program means for controlling said variable braking means for controlling deceleration of said roll in a predetermined relationship of decreasing speed of said roll to elapsed time of actuation of said variable braking means.

25. Apparatus for controlled braking of a textile material engaging roll driven by a drive means, said roll being arranged for winding of textile material thereabout, said apparatus comprising fluid-actuated means for braking said roll, means for supplying a pressurized operating fluid to said fluid-actuated braking means at a selectively variable pressure for generation of a correspondingly variable braking force by said fluid-actuated braking means, braking program means for controlling said fluid supplying means for controlling the pressure at which the pressurized operating fluid is supplied to said braking means for controlling deceleration of said roll in a predetermined relationship of decreasing speed of said roll to elapsed time of actuation of said braking means, and means for determining the wound diameter of textile material on said roll, said diameter determining means comprising means for ultrasonic measuring of the radial depth of textile material windings on said roll, said braking program means including means for adjusting said predetermined speed-to-time relationship according to the total mass of said roll and textile material wound thereabout as a function of the determined wound diameter of textile material on said roll.

26. Apparatus for controlled braking of a textile material engaging roll driven by a drive means, said apparatus comprising fluid-actuated means for braking said roll, means for supplying a pressurized operating fluid to said fluid-actuated braking means at a selectively variable pressure for generation of a correspondingly variable braking force by said fluid-actuated braking means, said fluid supplying means comprising adjustable valve means for varying supply of said fluid to said braking means, said valve means being electrically adjustable in relation to varying of a characteristic of an operating electrical supply thereto, and braking program means for controlling said valve means for controlling the pressure at which the pressurized operating fluid is supplied to said braking means for controlling deceleration of said roll in a predetermined relationship of decreasing speed of said roll to elapsed time of actuation of said braking means.

27. Apparatus for controlled braking of a driven textile material engaging roll according to claim 26 and characterized further in that said braking means is adapted for actuation by pressurized air.

28. Apparatus for controlled braking of a textile material engaging roll driven by a drive means, said roll being arranged in a textile warping system for engagement of a plurality of textile materials traveling in side-by-side arrangement, said apparatus comprising fluid-actuated means for braking said roll, means for supplying a pressurized operating fluid to said fluid-actuated braking means at a selectively variable pressure for generation of a correspondingly variable braking force by said fluid-actuated braking means, and braking program means for controlling said fluid supplying means for controlling the pressure at which the pressurized operating fluid is supplied to said braking means for controlling deceleration of said roll in a predetermined relationship of decreasing speed of said roll to elapsed time of actuation of said braking means.

29. Apparatus for controlled braking of a driven textile material engaging roll according to claim 23, 24, 25, 26 or 28 and characterized further by means for detecting the speed of said roll, said braking program means including means for adjusting said predetermined speed-to-time relationship as a function of the driven speed of each said roll detected by said detecting means prior to actuation of said variable braking means.

30. Apparatus for controlled braking of a driven textile material engaging roll according to claim 29 and characterized further in that said detecting means comprises a tachometer associated with said drive means.

31. Apparatus for controlled braking of a driven textile material engaging roll according to claim 29 and characterized further in that said braking program means is adapted for controlling deceleration of said roll to a standstill within a substantially uniform distance of travel of a textile material engaging said roll from any speed of said roll within a range of possible driven roll speeds.

32. Apparatus for controlled braking of a driven textile material engaging roll according to claim 23, 24, 25, 26 or 28 and characterized further by means for monitoring tension in a textile material engaging said roll, said braking program means being adapted for controlling said variable braking means for controlling textile material tension in a predetermined relationship of tension to elapsed time of actuation of said variable braking means.

33. Apparatus for controlled braking of a driven textile material engaging roll according to claim 23, 24, 25, 26 or 28 and characterized further by means for detecting the speed of said roll, said braking program means including auxiliary control means responsive to said detecting means for controlling dynamic braking and driving of said roll drive means in conjunction with said variable braking means for correcting deviations in the detected speed of said roll from its said predetermined speed-to-time relationship.

34. Apparatus for controlled braking of a textile material engaging roll according to claims 23, 24, 25, 26 or 28 and characterized further in that said braking program means is operative for controlling deceleration of said roll from a full operating speed to a standstill.

35. Apparatus for controlled braking of a driven textile material engaging roll according to claim 12, 23, 14, 24, 15, 25, 17, 26 or 28 and characterized further in that said braking program means comprises a programmable logic controller.

* * * * *

UNITED STATES PATENT AND TRADEMARK OFFICE

CERTIFICATE OF CORRECTION

PATENT NO. : 5,052,088

DATED : Oct. 1, 1991

INVENTOR(S) : John F. Hagewood et al.

It is certified that error appears in the above-identified patent and that said Letters Patent is hereby corrected as shown below:

Column 6, Line 8, delete "Figure" and insert -- FIG. 1, -- therefor.

Column 7, Line 30, delete "26" and insert -- 68 -- therefor.

Column 7, Line 55, delete "and;" and insert -- and, -- therefor.

Column 8, Line 53, delete "8!" and insert -- 81 -- therefor.

Column 13, Line 9, delete "5!" and insert -- 51 -- therefor.

Column 16, Line 6, delete "drawn" and insert -- draw -- therefor.

Column 16, Line 8, delete "drawn" and insert -- draw -- therefor.

Column 16, Line 11, delete "tie" and insert -- time -- therefor.

Column 20, Line 14, delete "would" and insert -- wound -- therefor.

Column 20, Line 15, delete "would" and insert -- wound -- therefor.

Column 21, Line 46, delete "first, roll," and insert -- first roll, -- therefor.

Column 22, Line 1, delete "t" and insert -- to -- therefor.

Column 22, Line 17, delete "variably" and insert -- variable -- therefor.

Signed and Sealed this

Tenth Day of August, 1993

*Attest:*

Michael K. Kirk

MICHAEL K. KIRK

*Attesting Officer*

*Acting Commissioner of Patents and Trademarks*